United States Patent [19]

Lombardi et al.

[11] 4,373,720

[45] Feb. 15, 1983

[54] TENNIS PRACTICE BACKBOARD

[75] Inventors: John P. Lombardi, Sterling, Va.; Tore M. Hult, Bethesda, Md.; Robert H. Trowbridge, Jr., Leesburg, Va.

[73] Assignee: Jimmy Connors Rally Champion Enterprise, Sterling, Va.

[21] Appl. No.: 175,743

[22] Filed: Aug. 6, 1980

[51] Int. Cl.[3] ..... A63B 61/00; A63B 69/38

[52] U.S. Cl. ..... 273/29 A; 273/DIG. 8

[58] Field of Search ..... 273/29 A, 26 A, DIG. 7, 273/DIG. 8, 30, 176–182, 185 R, 184, 1 R; 428/315; 521/51; 52/600

[56] References Cited

U.S. PATENT DOCUMENTS

| | | | |
|---|---|---|---|
| 3,643,959 | 2/1972 | Cornell | 273/185 R |
| 3,825,259 | 7/1974 | Burchett | 273/29 A |
| 3,904,199 | 9/1975 | Burchett | 273/29 A |
| 4,093,218 | 6/1978 | Burchers | 273/29 A |

FOREIGN PATENT DOCUMENTS

| | | | |
|---|---|---|---|
| 234082 | 6/1961 | Australia | 273/1 R |
| 2248993 | 4/1973 | Fed. Rep. of Germany | 273/29 A |
| 2308082 | 8/1974 | Fed. Rep. of Germany | 273/29 A |
| 2542984 | 3/1977 | Fed. Rep. of Germany . | |
| 2558968 | 7/1977 | Fed. Rep. of Germany . | |
| 2606071 | 8/1977 | Fed. Rep. of Germany . | |
| 2630772 | 12/1977 | Fed. Rep. of Germany . | |
| 2822255 | 7/1978 | Fed. Rep. of Germany | 273/29 A |
| 7541645 | 8/1978 | Fed. Rep. of Germany . | |
| 8010714 | 4/1980 | Fed. Rep. of Germany . | |
| 545114 | 1/1974 | Switzerland . | |

*Primary Examiner*—Richard C. Pinkham
*Assistant Examiner*—T. Brown
*Attorney, Agent, or Firm*—Cushman, Darby & Cushman

[57] ABSTRACT

A tennis practice backboard is provided that allows a tennis ball hit against the practice backboard to return to approximately the same spot at about the same height every time. The system is constructed at the tennis court from a plurality of panels. The panels are concaved and formed of structural polyurethane foam material, the top of the backboard is tilted backwardly with respect to the bottom by a small positive angle, adjacent panels of the backboard are fastened to one another, brackets are fastened to the panels, horizontal members are connected to the brackets whereby the horizontal members are mounted to posts of a tennis court fence, the panels are not affected by humidity, wind, rain, cold, heat or other adverse weather conditions.

9 Claims, 6 Drawing Figures

31
V
L
10
38
43
42
39
38
14
43
39
α
39
38
41
45
34

TENNIS PRACTICE BACKBOARD

BACKGROUND AND SUMMARY OF THE INVENTION

The invention relates to a tennis practice backboard, panels for use in fenced-in tennis court. In constructing a tennis practice backboard, it is desirable to provide a hitting surface that allows the ball to return to approximately the same spot at just about the same height every time, encouraging longer and better rallies. It is also desirable to provide such a system that can be used by a player standing a significant distance away from the practice backboard (e.g., up to 39 feet away) so that the ability to return a ball hit against the rebound surface is not merely dependent upon quick reflexes, but more closely simulates actual play conditions. It is also desirable to have such a system that may be constructed at the site of the tennis court, and releasably mounted to the fencing for the tennis court, avoiding the use of special mounting systems and anchoring systems, and facilitating replacement of any damaged component part. Such a system must also be able to withstand humidity, wind, rain, cold, heat, and other weather conditions without being adversely effected.

According to the present invention, a tennis practice backboard (and panel associated therewith and method for constructing the same) is provided that satisfies all of the above-enumerated conditions. The system is formed by a plurality of rebound panels, each having a rebound surface curved about first and second perpendicular axes, and means for attaching the panels together in abutting relationship to provide a concave tennis rebound backboard. Means are provided for mounting the tennis rebound backboard so that the top thereof is tilted backwardly with respect to the bottom thereof so that the backboard is tilted an angle $\alpha$ from vertical. The concave rebound surface when mounted in this manner allows the ball to return to approximately the same spot and at just about the same height every time it is impacted thereagainst, and allows the player to stand up to 39 feet (the distance from the base line to the net on a conventional tennis court) away when using the system.

The panels utilized in the tennis practice backboard each have a rebound surface that is concave, and consist essentially of an integral structure of self-skinning structural polyurethane foam having a density of about 4 to 80 pounds per cubic foot (preferably about 40 pounds per cubic foot), a skin density at the rebound surface of about 20 to 80 pounds per cubic foot (preferably about 56 pounds per cubic foot) and a skin hardness of about 35 to 90 (preferably about 80) on the Shore D scale and 50 to 95 on the Shore A scale. Formed in such a way, the panels are easy to construct into a practice backboard, yet are tough, strong, and durable. They are not adversely affected by temperatures from −20° F. to 200° F., nor are they adversely affected by wind, rain, or other weather conditions. An integral circumferential lip extends away from the concave surface around the entire circumference of each panel, and a plurality of openings are formed in the circumferential lip for receipt of fasteners for attaching the panels together in abutting relationship, and attaching them to the means for mounting them in an upright position. The concave rebound surface is preferably quadrate, and each panel may have a thickness of about 3", with the concave rebound surface itself having a thickness of about ½".

The panels may be readily shipped, with mounting hardware, to a fenced-in tennis court for erection on site. At the tennis court the panels are attached together in abutting relationship with removable fasteners to provide a concave tennis backboard and the backboard is releasably mounted to the tennis court fence so that it is upright. Mounting may be accomplished utilizing a plurality of horizontally extending members, a plurality of brackets attached to each of the horizontally extending members and extending outwardly therefrom, means for attaching each of the brackets to a panel (such as bolts and nuts) and means for attaching each of the horizontally extending members to the fence posts for the tennis court fence (such as U-bolts or cables). The tennis practice backboard may thus readily be constructed on site without any special mounting or anchoring structures, may be disassembled if desired, and may have the component parts thereof readily replaced if damaged.

It is the primary object of the present invention to provide a simple, efficient, durable and easily constructed tennis practice backboard. This and other objects of the invention will become clear from an inspection of the detailed description of the invention and from the appended claims.

DETAILED DESCRIPTION OF THE INVENTION

Figure 1:
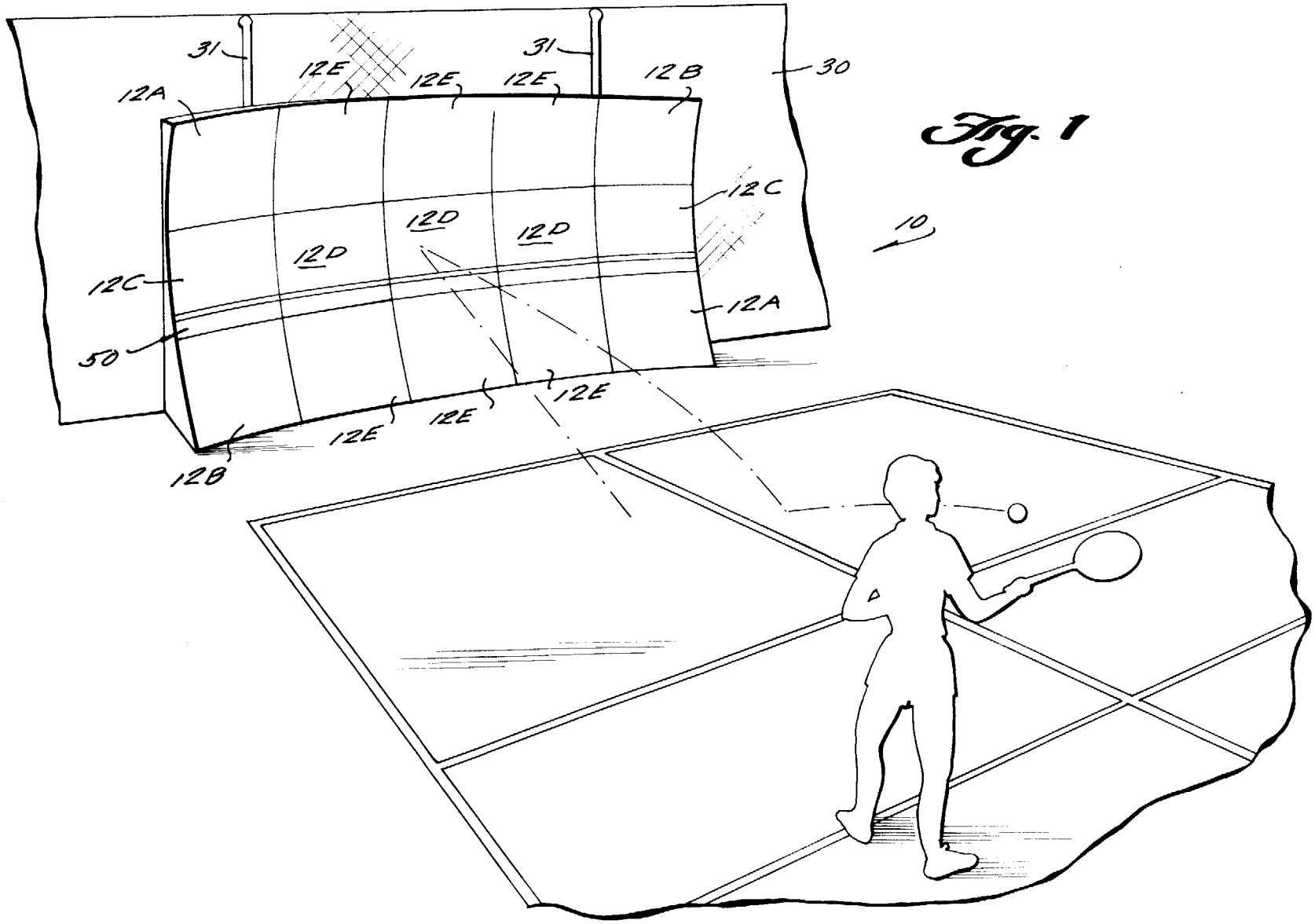
FIG. 1 is a perspective view of an exemplary tennis practice backboard according to the present invention in use at a conventional fenced-in tennis court.
Figure 2:
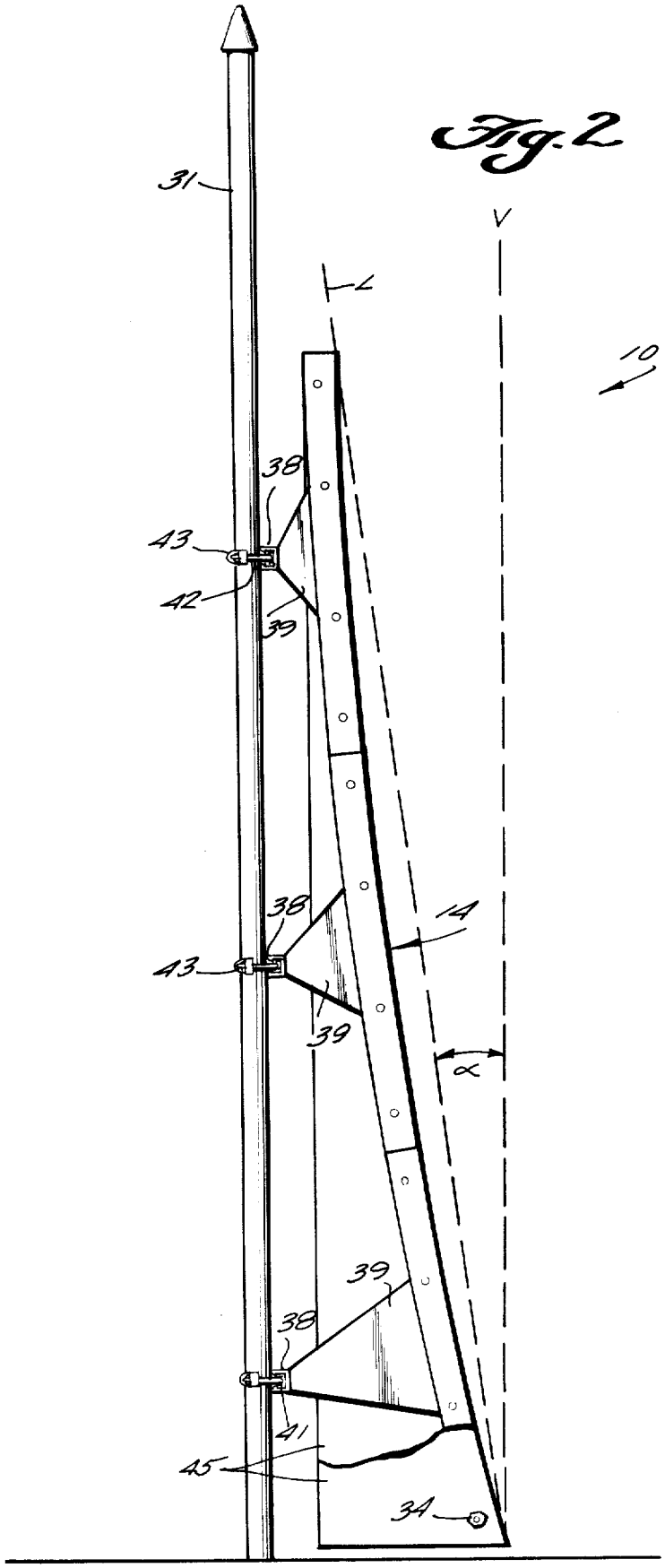
FIG. 2 is a side view of the practice backboard of FIG. 1 with one of the side boards thereof cut away for clarity of illustration.
Figure 3:
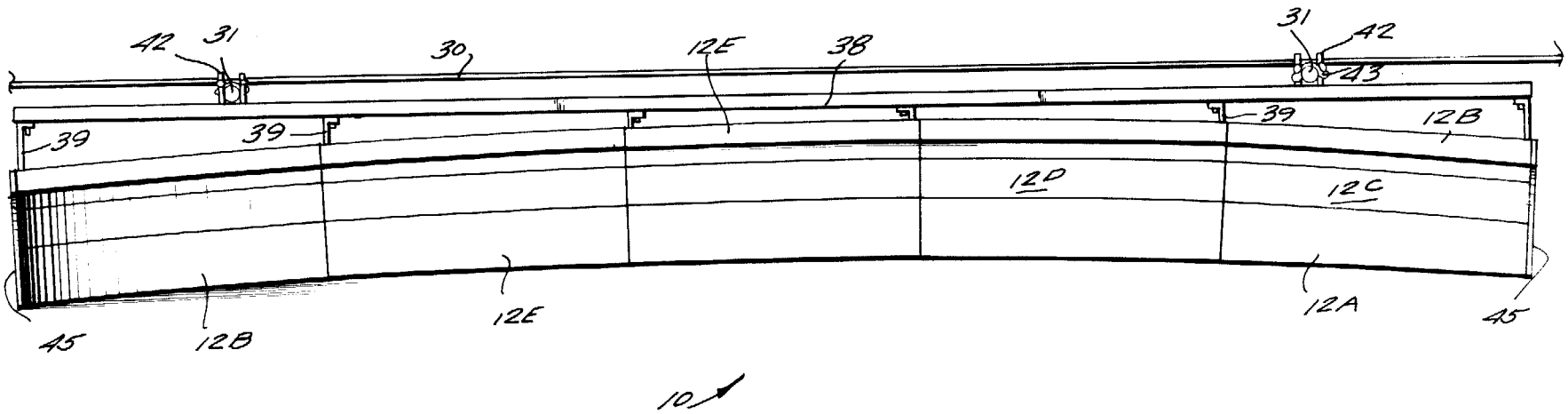
FIG. 3 is a top plan view of the system of FIG. 1.
Figure 4:
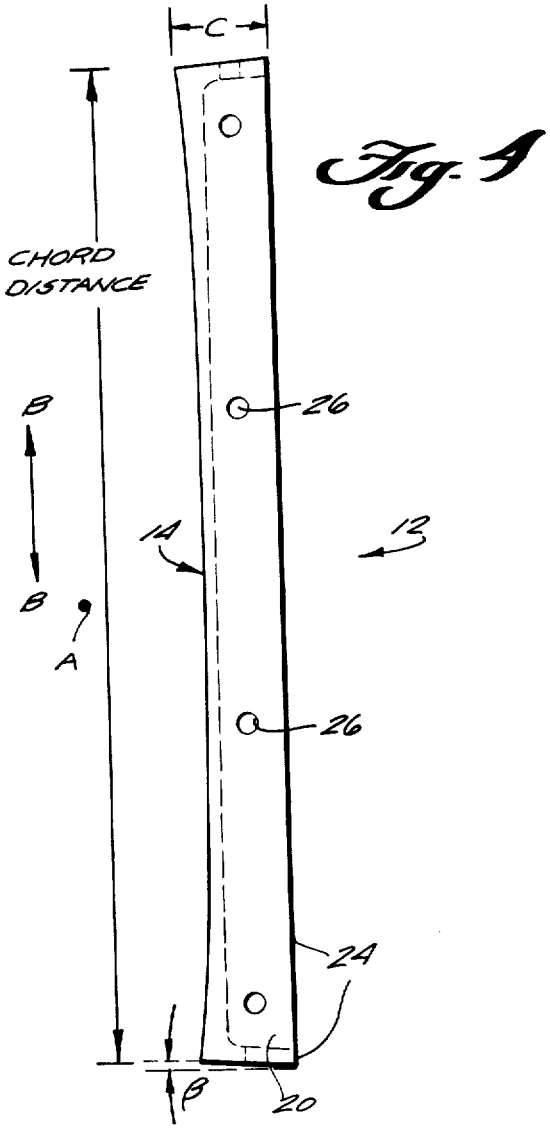
FIG. 4 is a side view of an exemplary panel for the tennis practice backboard according to the present invention.

An exemplary tennis practice backboard according to the present invention is shown generally at 10 in FIGS. 1 through 3. The practice backboard is constructed from a plurality of rebound panels, such as a panel 12 which is shown in detail in FIGS. 4 through 6. Each panel, such as panel 12, has a rebound surface 14 thereof that is curved about both first (A—A) and second (B—B) perpendicular axes. Thus each rebound surface 14 is concave.

The panels, such as panel 12, are moulded from a structural polyurethane foam. Each panel consists essentially of an integral structure of self-skinning structural polyurethane foam. The foam core 16 (see FIG. 6) has a density of about 4 to 80 pounds per cubic foot (preferably about 40 pounds per cubic foot). The skin 18, particularly at rebound surface 14, has a density of about 20 to 80 pounds per cubic foot (preferably about 56 pounds per cubic foot) and the skin hardness is about 30 to 90 (preferably about 80) on the Shore D scale and 50 to 95 on the Shore A scale.

Figure 5:
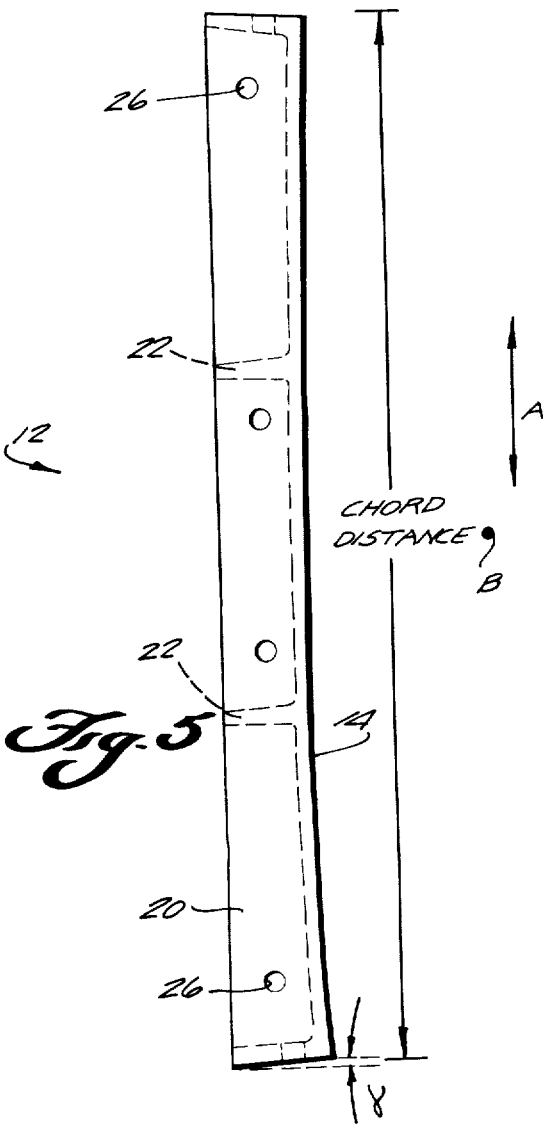
FIG. 5 is a top plan view of the panel of FIG. 4.
Figure 6:
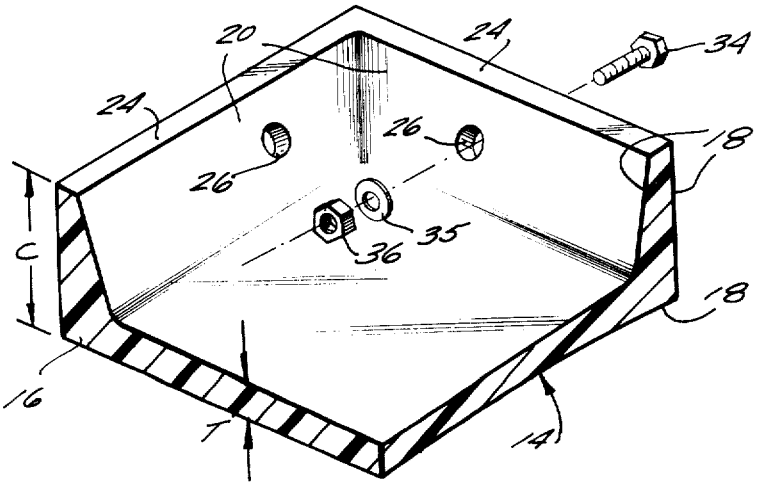
FIG. 6 is a detailed cross-sectional view at a corner of the panel of FIGS. 4 and 5.

Each panel, such as panel 12, has an integral circumferential lip 20 extending away from the concave rebound surface 14 and disposed around substantially the entire circumference thereof. Each panel, such as the panel 12, is preferably quadrate, and a plurality of interior ribs 22 (see FIG. 5) are formed within the volume defined by the circumferential lip 20 and extend from one portion of the lip to another while supporting the concave surface 14. As illustrated in FIG. 5, the ribs 22 may extend from the top to the bottom of the panel 12 and be parallel to the sides of the lip 20. Each panel may have a thickness C (see FIG. 4), including the lip 20, of about 3" while the concave rebound surface 14 itself has a thickness T of about ½" (see FIG. 6).

The circumferential lip 20 terminates in a rim 24 having all surface portions thereof disposed in a common plane (see FIGS. 4 and 5 in particular), and the lip 20 makes a small positive angle (see $\beta$ in FIG. 4 and $\lambda$ in FIG. 5) with respect to a normal to the common plane around the entire circumference thereof. The angle $\beta$ typically would be 4° while the angle $\lambda$ typically would be 2'.

The circumferential lip 20 includes means for defining a plurality of openings 26 therein, the opening 26 provided to receive fasteners for attaching the panels together (e.g., for receiving bolts). Openings 26 are formed in 2, 3, or 4 surfaces of the lip 20 depending upon the particular position of the panel within the matrix forming the backboard. For instance in the typical matrix illustrated in FIG. 1 wherein the rebound board is constructed of 15 panels (3 panels high and 5 panels wide), two panels 12A will be provided having openings 26 formed into three particular sides of lip 20 thereof, two panels 12B will be provided having openings 26 disposed in a different three particular sides of lips 20 thereof, two panels 12C will be provided having openings 26 formed in yet another three particular sides of the lips 20 thereof, three panels 12D will be provided having openings 26 formed on all four sides thereof, and six panels 12E will be provided having openings 26 formed in still another three particular sides of the lips 20 thereof. All panels having the same letter designation (e.g., all panels 12E) are interchangeable with each other.

A typical panel 12 formed according to the present invention could be formed of a reaction injection of rigid structural polyurethane foam, such as Mobay Chemical Systems 722-Baydur Foam with a lacquer barrier coat moulded into the rebound surface 14, having a skin hardness of 80 on the Shore D scale, a skin density of 56 pounds per cubic foot, a core density of 40 pounds per cubic foot, a vertical chord distance of about 31.9" (see FIG. 4) and a horizontal chord distance of about 33.6" (see FIG. 5). The radius of curvature of the rebound surface about horizontal axis A—A is thus about 39 feet, while the radius of curvature of the surface 14 about the vertical axis B—B is roughly about 78 feet. When assembled together, the panels provide a rebound backboard about eight feet high and about 14 feet wide.

The construction of the tennis practice backboard 10 from the panels 12 is accomplished utilizing means for attaching the panels together in abutting relationship so that a common concave surface is formed by the surfaces 14 of the panels 12, and means are provided for mounting the tennis rebound backboard in an upright position, preferably to a conventional fence 30 of a tennis court, having fence posts 31.

The means for attaching the panels 12 together so that the circumferential lips 20 thereof abut preferably include a plurality of bolts (e.g., bolt 33 in FIG. 6) with associated washers and nuts (34, 35 respectively), or other suitable releasable fasteners. The mounting means mount the rebound backboard 10 to the vertical fence posts 31 and preferably include a plurality of horizontally extending members 38 (preferably 3—one for each row of panels 12), a plurality of brackets 39 attached to each of the horizontally extending members 38 and extending outwardly therefrom (see FIGS. 2 and 3); means (such as the bolts 34 which are received in openings in brackets 39 aligned with openings 26 in the panel lips 20) for attaching each of the brackets to a panel 12, and means for attaching each of the horizontally extending members 38 to the fence posts 31. The brackets 39 may be integral with or releasably attached to the horizontally extending members 38 (e.g., attached by welding, rivets, bolts, etc.).

One preferred form of the means for attaching the horizontally extending members 38 to the fence posts 31 is illustrated in FIGS. 2 and 3. Each of the horizontally extending members in this preferred form comprises a hollow member (e.g., steel channel) as seen in FIG. 2. At least a pair of spaced openings are provided in one face thereof (although when formed as a channel a continuous opening is provided along the entire length of that face), with a solid portion, such as the reverse channel section 41 (see FIG. 2) spacing the openings. A U-bolt 42, cable, or like fastening component, passes through the spaced openings and into the hollow interior of the member 38 and engages the solid portion 41, as illustrated in FIG. 2. When the fastening component is a U-bolt, the cross-portion of the U engages the solid portion 41 with a conventional U-bolt clamp 43 engaging the fence post 31 on the opposite side thereof as the member 38 for receiving the legs of the U-bolt 42 and clamping it to the post 31. Where a cable is provided as the fastening component, the free ends thereof may be wrapped around the posts 31 and tightly tied to each other. In order to complete the assembly, a pair of side panels 45 are disposed on the opposite sides of the backboard 10, the side panels 45 attach to the panels 12 also using the bolts 34.

The brackets 39 are dimensioned (see FIG. 2) so that when the horizontally extending members 38 are clamped to the fence posts 31, the top of the backboard is tilted backwardly with respect to the bottom thereof a small positive angle $\alpha$ (see FIG. 2 in particular); that is so that a straight line L between the bottom and top of the panel system 10 makes the angle $\alpha$ with respect to the vertical V. In FIG. 2, the angle $\alpha$ is roughly about 7°. Constructed and mounted in the manner illustrated in FIGS. 1-3, the backboard 10 according to the invention will allow a ball hit thereagainst to return to approximately the same spot at just about the same height every time, and allow the player to stand a significant distance away from the backboard 10 (e.g., up to about 39 feet).

It will thus be seen that according to the present invention a tennis practice backboard has been provided which is simple, durable, efficient, and easy to construct. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A tennis practice backboard comprising a plurality of rebound panels, each having a rebound surface curved about a first axis, wherein each of said panels consists essentially of an integral structure of self-skinning structural polyurethane foam having a density of about 4–80 lbs./ft.$^3$, a skin density of about 20–80 lbs./ft.$^3$, and a skin hardness of about 30–90 on the Shore D scale and 50 to 95 on the Shore A scale, and wherein each of said panels has an integral circumferential lip extending away from said concave surface thereof;

means for attaching said panels together in abutting relationship to provide a tennis rebound backboard curved about a common said first axis;

means for attaching each of a plurality of brackets to a said panel;

wherein said means for attaching said panels together comprise a plurality of fasteners passing through adjacent lips of adjacent panels, and passing through adjacent lips and brackets; and means for mounting said tennis rebound backboard so that said first axis is horizontal and so that the top of said backboard is tilted backwardly with respect to the bottom thereof a small positive angle $\alpha$.

2. A tennis practice backboard as recited in claim 1 wherein each of said panels has a density of about 40 lbs./ft.$^3$, a skin density of about 56 lbs./ft.$^3$, and a skin hardness of about 80 on the Shore D scale.

3. A tennis practice backboard associated with a tennis-court enclosing screen fence having vertically upstanding fence posts, and comprising:

a plurality of rebound panels, each having a rebound surface curved about a first axis;

means for attaching said panels together in abutting relationship to provide a tennis rebound backboard curved about a common said first axis; and means for mounting said tennis rebound backboard so that first axis is horizontal and so that the top of said backboard is tilted backwardly with respect to the bottom thereof a small positive angle $\alpha$, said means comprising means for mounting said rebound backboard to the tennis court-enclosing screen fence having vertically upstanding fence posts, said mounting means including a plurality of horizontally extending members; a plurality of brackets attached to each of said horizontally extending members and extending outwardly therefrom; means for attaching each of said brackets to the said panel; and means for attaching each of said horizontally extending members to said fence posts;

each of said horizontally extending members comprising a hollow member having means defining a pair of spaced openings in one face thereof with a solid portion spacing said openings; and each of said means for attaching each of said horizontally extending members to a fence post comprising a fastening component passing through said spaced openings and into the hollow interior of said horizontally extending member and engaging said solid portion thereof, and connected to said fence post.

4. A tennis practice backboard as recited in claims 3 or 1 wherein each of said panels have a surface curved about a second axis, perpendicular to said first axis and wherein said means for attaching said panels together attach them together so that they provide a concave tennis rebound backboard; and wherein said means for mounting said tennis rebound backboard mount said backboard so that said second axis is substantially vertical, tilted substantially said angle $\alpha$ from vertical.

5. A backboard as recited in claim 3 wherein said fastening component comprises a U-bolt having the cross-portion of the U engaging said solid portion, with a U-bolt clamp engaging the fence post on the opposite side thereof as said horizontally extending member for clamping said U-bolt to the fence post.

6. A backboard as recited in claim 5 wherein each said horizontally extending member includes means defining a slit along substantially the entire horizontal length of said one face thereof, and wherein said solid portion is formed by a channel-shaped member disposed within said hollow horizontally extending member, and having its base vertically spanning the slit.

7. A tennis practice backboard comprising fifteen rebound panels disposed in a matrix three panels high and five panels across, each panel having a concave rebound surface curved about a first axis and curved about a second axis, perpendicular to said first axis;

means for attaching said panels together in abutting relationship to provide a tennis rebound backboard curved about a common said first axis and so that they provide a concave tennis rebound backboard; and means for mounting said tennis rebound backboard so that first axis is horizontal and so that the top of said backboard is tilted backwardly with respect to the bottom thereof a small positive angle $\alpha$, and so that said second axis is substantially vertical, tilted substantially said angle $\alpha$ from vertical.

8. A backboard as recited in claim 7 wherein said 15 panels comprise 5 different types of panels differing slightly, including 2 panels of a first type, 2 panels of a second type, 2 panels of a third type, 3 panels of a fourth type, and 6 panels of a fifth type.

9. A tennis practice backboard associated with a tennis-court enclosing screen fence having vertically upstanding fence posts, and comprising a plurality of rebound panels, each having a rebound surface curved about a first axis, and each of said panels having an integral circumferential lip extending away from said concave surface thereof;

means for attaching said panels together in abutting relationship to provide a tennis rebound backboard curved about said first axis; and means for mounting said tennis rebound backboard so that first axis is horizontal and so that the top of said backboard is tilted backwardly with respect to the bottom thereof a small positive angle $\alpha$, said means comprising means for mounting said rebound backboard to the tennis court-enclosing screen fence having vertically upstanding fence posts, said mounting means including a plurality of horizontally extending members; a plurality of brackets attached to each of said horizontally extending members and extending outwardly therefrom; means for attaching each of said brackets to a said panel; and means for attaching each of said horizontally extending members to said fence posts;

said means for attaching each of said brackets to a said panel and said means for attaching said panels together comprising a plurality of fasteners passing through adjacent lips of adjacent panels, and passing through adjacent lips and brackets.

* * * * *